United States Patent [19]

Baldi

[11] 4,347,267

[45] Aug. 31, 1982

[54] DIFFUSION COATING THROUGH RESTRICTIONS

[75] Inventor: Alfonso L. Baldi, Wynnewood, Pa.

[73] Assignee: Alloy Surfaces Company, Inc., Wilmington, Del.

[21] Appl. No.: 230,333

[22] Filed: Feb. 2, 1981

Related U.S. Application Data

[63] Continuation-in-part of Ser. No. 89,949, Oct. 31, 1979, abandoned.

[51] Int. Cl.[3] ..... B05D 7/22; B05D 7/14; C23C 13/02

[52] U.S. Cl. ..... 427/237; 427/239; 427/250; 427/252

[58] Field of Search ..... 427/237, 250, 239, 252

[56] References Cited

U.S. PATENT DOCUMENTS

| | | | |
|---|---|---|---|
| 3,764,371 | 10/1973 | Baldi | 427/253 |
| 3,801,357 | 4/1974 | Baldi | 427/250 |
| 3,867,184 | 2/1975 | Baldi et al. | 427/252 |
| 3,958,046 | 5/1976 | Baldi | 427/252 |
| 4,041,196 | 8/1977 | Baldi et al. | 427/252 |
| 4,132,816 | 1/1979 | Benden et al. | 427/253 X |
| 4,148,275 | 4/1979 | Benden et al. | 427/237 X |
| 4,154,705 | 5/1979 | Baldi et al. | 252/472 X |
| 4,197,336 | 4/1980 | Savchenko et al. | 427/237 X |

*Primary Examiner*—James R. Hoffman
*Attorney, Agent, or Firm*—Connolly and Hutz

[57] ABSTRACT

Diffusion coating of internal surface of workpiece accessible only through very narrow passageway, is simply effected by coating that surface with uniform layer of particles of the metal to be diffused into it, and then holding the thus-prepared workpiece at diffusion-coating temperature in a diffusion-coating atmosphere.

18 Claims, 2 Drawing Figures

DIFFUSION COATING THROUGH RESTRICTIONS

This application is in part a continuation of application Ser. No. 89,949, filed Oct. 31, 1979 and subsequently abandoned.

The present invention relates to the diffusion coating of the interior of a hollow workpiece where that interior is accessible only through a restricted passageway.

Such coating is highly desirable for example to increase the resistance of the workpiece to attack. Thus, as described in U.S. Pat. Nos. 4,132,816 and 4,148,275, jet engine blades and vanes that have internal cooling passages frequently require the diffusion coating of the surfaces of those passageways to increase their resistance to attack by the hot combustion products to which they are subjected. These patents suggest that such coating by effected by forcing a gaseous specially formulated diffusion coating composition through the passageways to be coated while the workpieces are heated to diffusion coating temperature. Other suggestions appear in British specifications Nos. 1,545,584, 1,497,694 and 1,434,770.

Among the objects of the present invention is the provision of a novel technique for diffusion coating through restricted passageways.

Additional objects of the present invention include the provision of a diffusion coating process which very uniformly coats through restricted passageways without requiring forced circulation through the passageways.

Figure 1:
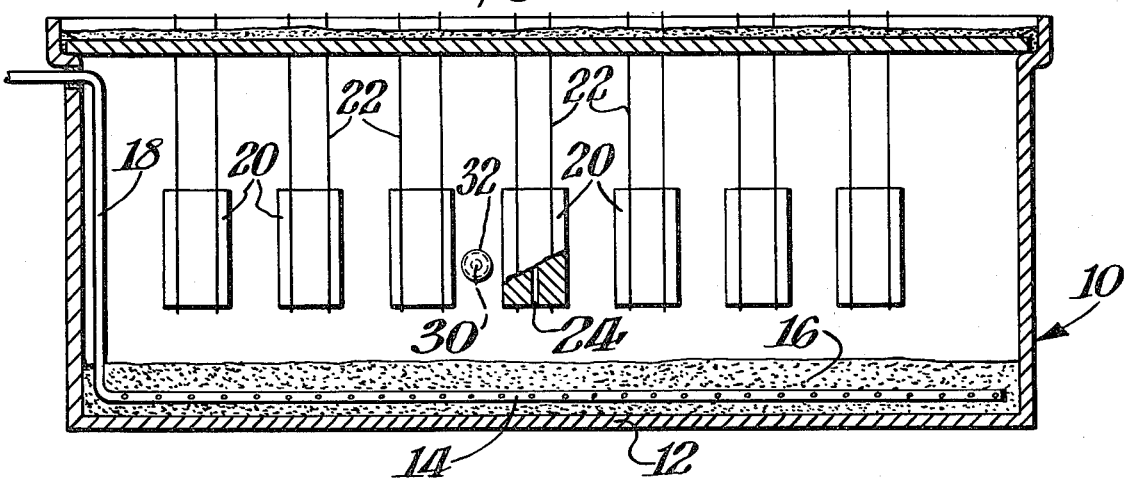
Figure 2:
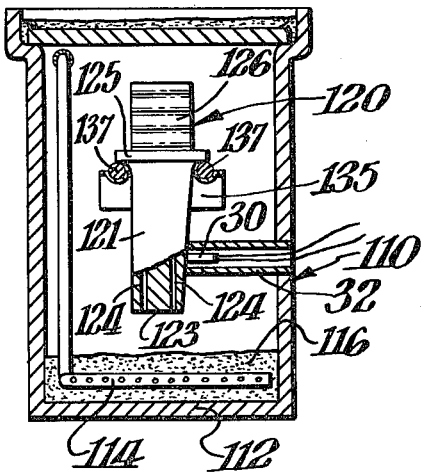

The foregoing as well as additional objects of the present invention will be more fully appreciated from a consideration of the following description of several of its exemplifications, reference being made to the accompanying drawings, wherein:

FIG. 1 is a vertical sectional view of a diffusion coating set-up for practicing the present invention; and FIG. 2 is a similar view of a modified set-up pursuant to the present invention.

According to the present invention diffusion coating of the internal surface of a hollow in a metal workpiece where that hollow is accessible only through a passageway less than about 5 millimeters wide, is readily effected by applying over that internal surface an essentially uniform layer of particles consisting essentially of all the metal to be diffused into that surface, and the workpiece so treated is subjected to diffusion coating temperature while the hollow is exposed through the passageway to a diffusion coating atmosphere.

The layer of particles is conveniently applied as a layer of a dispersion of the particles in a binder that is driven off at diffusion coating temperatures. A water dispersion of aluminum particles, such as is described in U.S. Pat. No. 3,318,716, can be used, but it is preferred to use dispersion vehicles in which heavier metals such as chromium can also be fairly uniformly dispersed. A 1 to 10% by weight solution of an acrylic resin such as ethyl methacrylate in methylchloroform makes a very desirable dispersion medium in which powdered chromium, powdered aluminum, mixtures of these powders, and other metals like powdered cobalt, in particular sizes up to about 150 microns are easily suspended to make a fairly uniform mobile suspension that does not settle out appreciably for the minute or so needed to apply the suspension and then distribute it as a uniform coating.

Settling can be slowed by dissolving in the suspension vehicle a long-chain acid such as $C_{12}$ to $C_{50}$ aliphatic acid, or a copolymer of ethylene and acrylic acid, as described in U.S. patent application Ser. No. 752,855 filed Dec. 21, 1976, now U.S. Pat. No. 4,208,453. Only about 0.3% to about 0.5% by weight of such additive is very helpful. Low-foaming non-ionic surface active agents such as polyethoxy ethers of linear alcohols like cetyl alcohol or of an alkyl phenol, in amounts as low as 0.1% to 0.3% by weight can also be used to slow the settling of the suspended particles.

With the very narrow passageways involved in the present invention, the mobile dispersion coatings do not spread into uniform layers, but build up in excessive thicknesses by reason of surface effects. Thus a passageway about 1 millimeter in diameter will generally be completely filled with the mobile dispersion. It is accordingly necessary to expel the excess dispersion as by applying suction to the passageway opening to suck out gas as a rapid stream that carries along with it all but a residual thin and quite uniform layer of the dispersion. Suction from a simple water-pump suction generator or from a suction pump that applies a suction of about ¼ to about 1/10 atmospheric pressure or less, as measured on a pressure gauge, is adequate.

Where the passageway whose coating is to be levelled has separate outlets at its opposite ends, the redistribution is easily effected by directing a stream of compressed air into one of the outlets. A stream propelled by a 15 pounds per square inch gauge source of air is quite effective.

The excess dispersion can also be expelled by centrifugal force. Spinning the heavily coated workpiece in a centrifuge at about 10 to 20 times gravity for a few seconds does a good job of levelling where the centrifugal force is directed longitudinally of a filled passageway, for example. For complicated passageways it may be necessary to spin the workpiece in steps, each step with a different orientation.

The following examples illustrate the present invention more fully.

EXAMPLE 1

Into a short retort box 10 as in FIG. 1, a half-inch layer 12 of a diffusion aluminizing powder mix is poured, following which a perforated flushing tube 14 is placed over the mix and then another two-inch layer 16 of the mix covers the perforated tube.

The retort box and the tube are made of Inconel 600 and the mix has the following formulation by weight:

| | |
|---|---|
| Aluminum powder about 40 micron particles | 15% |
| Alumina powder about 200 to 300 micron particles | 85% |
| $NH_4Cl$ powder | ¾% based on the Al plus $Al_2O_3$ total |

More finely divided particles such as of calcined alumina, can also be used.

The tube 14 runs to and fro the length of the box, with each run about 1½ inches from the next, and its perforations are 1/16 inch holes. It is connected to an unperforated supply extension 18 that leads out of the retort box to a source of argon. The retort wall opening through which extension 18 passes, can be sealed as by welding or filled with tamped powder or fiber to permit a pressure build-up within the retort. Very fine alumina or ceramic fibers is suitable.

Suspended by sturdy nickel wires 22 hooked over the tops of the side walls of the box, are a series of blocks 20 of nickel-base alloy having 7% aluminum, 14.5% molybdenum and 7% tungsten, the balance being essentially nickel. Each block is about an inch high and has a central cylindrical bore 24 about 23 mils in diameter penetrating its entire height.

Also placed in the retort is a thermocouple 30 inserted in a thimble 32 welded to an inside wall and opening to the exterior through a perforation in the wall.

Before the blocks 20 are placed in the retort, they first have their passageways 24 filled with a dispersion of 30 grams 325 mesh aluminum powder in 40 cc. of a 5% by weight solution of poly(ethyl acrylate) resin in methyl chloroform. A suction hose is then promptly applied to one end of aperture 24 to suck out excess dispersion. The blocks so treated are permitted to stand a few minutes to set the residual coating.

The exteriors of the blocks are then painted with a 10 milligram per square centimeter layer of the masking slurry of $Ni_3Al$ powder as described in U.S. Pat. No. 3,801,357, and the slurry coating permitted to dry. The $Ni_3Al$ is best combined with a little chromium, as pointed out in that patent, when the alloy being coated contains chromium.

After being loaded, the retort box 10 is covered with a lid 36 which can also be made semi-tight by asbestos fibers tamped around its periphery. The covered box is placed inside an outer retort which is then covered by a furnace as shown in U.S. Pat. No. 3,801,357, and heated to 1900° F. where it is held for nine hours while argon or hydrogen is fed into the perforated tube at a rate that takes about one hour to supply a volume equal to the box volume. Flow of gas is best maintained before and at all times during the heat.

The heat is then turned off, the furnace lifted off the outer retort, and the retorts permitted to cool. The retort box 10 is opened when sufficiently cool, and the blocks 20 removed and cleaned of the masking layer. They then show a very uniform aluminized case about 2 mils thick over the entire internal surface of passageway 24. No cleaning is needed in that passageway, other than a light blow-out and rinsing off of residual halide with water.

The same results are obtained when the blocks are held 1/16 inch or 2 inches from the top of layer 16, and when the blocks are positioned in the retort box 10 with their passageways horizontally oriented. With such orientation the blocks can simply be laid on a screen placed on top of layer 16, so that no special work-supporting equipment is needed.

It is not necessary to force the energizer-container atmosphere through the narrow passage 24 as described in U.S. Pat. No. 4,148,275, nor is it necessary to use complex energizers with special throwing power, as described in U.S. Pat. No. 4,132,816.

EXAMPLE 2

In this example a group of jet engine blades with internal cooling passages have the walls of the passages heavily chromaluminized while the airfoil surfaces are lightly chromaluminized and the roots are given little or no external coating. Such a blade is schematically illustrated at 120 in FIG. 2 and has a number of passages 124 extending the entire length of its airfoil section 121 from the airfoil tip 123 to the opposite face of the mounting flange 125. At their extreme ends the passages are about 1 mil by 2 mils in cross section, and in their intermediate portions their cross section is a little larger.

The blades, which are made of B-1900 alloy, are cleaned by mild blasting with fine alumina grit, followed by degreasing. There is then introduced into the cooling passages, with the help of a medicine dropper or a pumped stream, a suspension of 40 grams 325 mesh aluminum powder and 5 grams 325 mesh chromium powder in 50 cc. of a 7% by weight solution of poly(methyl ethacrylate) resin and a 0.5 by weight solution of stearic acid in methyl chloroform. Suction from a water-pump is then promptly applied to each end of each passage in the airfoil for a few seconds, and the blade permitted to stand to cause the suspension remaining in the passages to dry. Excess suspension on the outside surface of the blade is removed with the help of a cloth wet with a little methyl chloroform, and a group of blades so prepared is loaded into previously prepared retort box 110. This box is similar to box 10, but made of type 304 stainless steel and it has shelves 135 welded onto its end-walls and carrying spaced rods 137 that span the box length. The blades are fitted between the bars with their airfoils 121 extending downwardly and their flanges 125 supported by the bars. The bars can be plain carbon steel heavily aluminized beforehand, and for example have a diffusionaluminized case at least about one mil thick with a maximum aluminum content of at least about 35% in the case. Where the blades have shrouds at the ends opposite the roots, the blades can be suspended by the shrouds.

In addition to the fitting of the aluminized rods, box 110 is prepared with layers 112, 116 having the same composition as layers 12 and 16. After loading the blades, the box is inserted in an outer retort and heated to 1950° F., while a slow stream of hydrogen is fed through perforated tube 114 at a rate that requires about ½ hour to supply an amount of hydrogen equal to the volume of the box. Before the heating is started the hydrogen stream is temporarily speeded up to more effectively replace the previous atmosphere in the box by hydrogen.

The 1950° F. temperature is maintained for 8½ hours, and the box then cooled. After sufficient cooling the hydrogen atmosphere is replaced by argon, and the box opened. The internal surfaces of the passages in the blade show an extremely uniform aluminized case about 2 to about 2.3 mils thick. The airfoil surfaces have an aluminized case about half as thick, and the blade root 126 about the same case thickness as the airfoil surfaces.

The flange 125 has its lower face aluminized to about the same extent as the airfoil surface, and has its upper face aluminized to about the same extent as the root. The aluminized lower face does not show a drop in aluminum content where that face rested on the bars 137. Quite the contrary it appears that the heavily aluminized bar surfaces help to aluminize the upper portions of the airfoil as well as the flange, and thus compensate for the greater distance of these surfaces from the powder 116.

The varying distance of the internal passageway portions from the powder 116 seems to have no significant effect inasmuch as the metal being diffused into the passageway surfaces is located at those surfaces. Such diffusion takes place relatively rapidly when a diffusion atmosphere reaches those surfaces after travelling 4 to 6 inches or more. Such as atmosphere need only be a vaporized diffusion energizer, such as a halogen or halogen compound, but the action of such an atmosphere is improved if it also contains a halide of the metal being diffused. Such an improved atmosphere is the usual atmosphere produced during diffusion coating, and powders 12, 16, 112, 116 are usual prior art diffusion coating powders.

The chromium present with the aluminum in the dispersion applied to the internal passages, diffuses into the passageway surfaces along with the aluminum and further improves the resistance of those surfaces to attack. The proportion of chromium can be increased and the aluminum completely eliminated to provide a chromized surface rather than an aluminized or chromaluminized surface. The chromium and aluminum particles can be pre-alloyed together if desired, or they can be mixtures of the separate metals.

For diffusion coating nickel-base superalloys with aluminum it is preferred that the aluminum content of aluminumchromium dispersions be greater than twice the weight of the chromium.

The metal particles in the metal dispersions should be not over about 3 mils in size, preferably not over 2 mils, where the passageway walls they are diffused into are to remain very smooth. Particles as small as 10 microns, or even two microns are preferred, particularly for small apertures.

The diffusion coating heat should be maintained at least as long as needed to cause all of the dispersion metal particles to diffuse into the passageway surfaces. This leaves those surfaces clean and ready for service without further treatment, except for a blow-out with air to make sure any foreign particles are not present. When the workpiece being coated is a nickel-based superalloy and the metal being diffused in is aluminum or chromium or mixtures of the two, at least about two hours is needed for every 0.1 mil of dispersed metal when the diffusion is effected at 1800° F., although somewhat shorter times can be used when the diffusing metal is mostly aluminum or when the diffusing temperature is increased. Silicon, cobalt, iron and other metals used to make diffusion coatings can be used in addition to or in place of the aluminum and/or chromium, and an aluminum-silicon mixture or inter-metallic, having 89% aluminum by weight is particularly desirable.

Cobalt-based superalloy workpieces require about twice the diffusion time that nickel-based superalloys take, but iron-base alloys such as RA 330 and Incoloy 800 take less time than the nickel-based superalloys. A cobalt-based superalloy MAR M 509 vane also with cooling passages, when subjected to treatment as in Example 2 but at 2000° F. for 20 hours provides excellent results.

EXAMPLE 3

First stage hot section jet engine vanes made of the nickel-based IN 100 alloy and with cooling passageways about 30 mils in diameter, are treated in the manner described in Example 2, but with the following specific differences:

(a) The powder on the floor of the retort is a chromizing powder mixture of 20% ultrafine chromium powder (particles less than 20 microns in size), 80% 325 mesh alumina, and 1% $NH_4Br$ based on the total weight of the chromium and alumina.

(b) The coating slurry is a dispersion of 15 grams of the ultrafine chromium in 20 cc. of the binder solution of Example 1.

(c) The vanes are held in their horizontal position about 1 inch above the powder on the floor.

(d) The inner retort box has its cover loosely applied without any attempt to seal its edges.

(e) The rods 137 are chromized Inconel 600.

(f) The diffusion coating was maintained at 1950° F. for 15 hours, but argon was introduced both into the interior of the box as well as around the box.

Both the external surfaces of the vanes and the surfaces of its cooling passageways are very effectively and uniformly chromized. Very good chromizing is also obtained when hydrogen is used in place of the argon, either in the interior or around the box, or both.

The powder on the retort floor need not have the same metal components as the powder in the passageways. Thus by having chromium as the only metal in the passageway powder and aluminum as the only metal in the powder on the retort floor, the passageways can be chromized while the exterior of the workpiece treated are aluminized. A little aluminum may appear in the chromized case on the passageway surfaces, particularly if the diffusion treatment is prolonged. The Al and Cr can be reversed in position.

Omitting all metal particles from the powder on the retort floor seems to slow down the diffusion case formation on the passageway surfaces, but good aluminizing, chromizing, and chromaluminizing is still obtained.

It is not essential that the process of the present invention be carried out with a flushing gas fed through the perforated tube 14 or 114. A little flushing does help flush away any vapors formed by the decomposition of whatever binder is used to hold the dispersed metal layer in place, but by the time the retort box reaches about 600° F. during heat-up, the flushing can be stopped unless the external diffusion coating is desired to be very uniform. Where the retort box is surrounded by another retort having a closely controlled atmosphere, such as is maintained when a stream of hydrogen, argon or other inert gas is flushed through the outer retort chamber only, flushing of the inner retort box need not be resumed except when the outer retort atmosphere is hydrogen or other combustible gas. In that event it is helpful to flush an inert gas through the inner and outer retorts to sweep away combustible gas before the retorts are opened.

During the dwell at diffusion-coating temperature, any flushing of the inner retort should not be so rapid as to sweep out too much activator from its atmosphere. The activator present in the powder on the retort floor is all converted to vapor by the time the heat-up brings the powder to about 700° F., and after such vaporization the flushing gas should not be supplied any faster than required to equal the volume in the inner retort space when flowing for a time corresponding to about one-twentieth the diffusion-coating time. The flushing action is not complete, particularly with a light gas such as hydrogen, so that with such maximum flow there is still some activator present at the end of the diffusion-coating heat.

Any halogen or halogen compound vaporized at diffusion-coating temperature can be used as an energizer. Where the diffusion is effected at relatively low temperatures, such as 1100°–1600° F., aluminum chloride can be used, particularly when aluminum is being diffused into a workpiece. Other energizers (sometimes called activators) are listed in U.S. Pat. No. 3,764,371.

The methyl chloroform solvent of Examples 1 and 2 can be replaced by other solvents such as methyl ethyl ketone, acetone, chloroform, toluene, isopropyl alcohol and the like. However, methyl chloroform is a particularly safe material to work with because it is practically impossible to ignite, and its hazard to health is extremely low. Water can also be used as a solvent with water-soluble binders, but it is generally not desirable to keep finely divided metal particles in contact with water for a long period of time.

Other acrylic resins that make effective binders include poly(methyl methacrylate) and the various polymeric acrylic and methacrylic esters of $C_1$ to $C_8$ alcohols, as well as polyacrylic acid and mixtures or copolymers of the monomers from which these are made. Other binders that can be used include rosin, polyethylene, polystyrene, methyl cellulose and even dimethyl silicone oils. The acrylic resins are driven off quite cleanly during the diffusion heat, but some binders might leave a little carbon behind and this would also diffuse into the workpiece surface.

The rods 137 of FIG. 2 preferably have their surfaces heavily chromized beforehand when chromizing the workpiece interiors. Similarly when diffusion coating workpieces with zinc, cobalt, or other metal, these rods or other work-engaging surfaces are preferably correspondingly precoated.

The powders 12 and 16 are not required to be located on the retort floor, but can be held in baskets below or even above the workpieces. The activating vapors generated by these powders have a throwing power of as much as six inches. An easily vaporized metal halide such as aluminum chloride can be introduced into the inner retort as a vapor carried by the flushing gas, and no powder is needed other than in the fine passageways.

The diffusion cases formed on the internal surface of cooling passageways pursuant to Examples 1, 2 and 3 are of the so-called "inward" diffusion type. In this type the diffusion is a highly active one that carries the diffusing-in metal into the substrate metal sufficiently rapidly to cause carbide phases originally present in the substrate to appear in the outer portion of the diffusion case.

Diffusion cases usually show at least two clearly distinguishable zones—an outer zone which is called the addition zone and is very rich in the coating metal or metals; and an inner zone which is called the diffusion zone, is very rich in the metals originally present in the substrate, and also contains appreciable amounts of the coating metal or metals. In many cases a relatively sharp phase boundary is evident between the foregoing zones, on metallographic inspection.

The "inward" type diffusion referred to above leaves the carbide phases in the addition zone.

However the diffusion coating formed on the exteriors of the blades in Example 2, for instance, are of the so-called "outward" diffusion type. This results from the relatively low activity of the diffusion into those exteriors. Carbide phases originally in the substrate will be found in the diffusion zone, and the substrate metal being more rapidly diffused will diffuse out beyond such phases.

Where an "inward" diffusion case is desired on the outer surfaces of the substrate, the diffusion activity at those surfaces is increased, as by coating those surfaces, before the diffusion heat, with a layer of the diffusion coating slurry. Even a slurry layer as thin as 0.1 mil thick will generally be adequate to obtain to an "inward" coating, although a one-mil thick layer provides more assurance. Increasing the activity of the energizer, as by using mixtures of equal weights of $NH_4Cl$ and $NH_4HF_2$ is also helpful in obtaining an "inward" diffusion.

The so-called "outward" diffusion coatings are frequently characterized by collection of oxide inclusions in a stratum just below the diffusion zone, and such stratification tends to detract from some of the properties of the diffusion coated product. This tendency is avoided when the diffusion is converted to one of the "inward" type.

On the other hand an "outward" type diffusion is not necessarily undesirable, particularly for internal surfaces of substrates, and can be provided there by reducing the activity of the slurry coating used. Thus the use of aluminum-chromium mixtures in which the aluminum content is about ¼ the chromium content by weight, effects diffusion coating at a very low activity and deposits an "outward" type diffusion case. "Outward" type diffusions are also more readily obtained when inert refractory diluent is mixed with the metal particles in the coating slurry, or when a dry mixture is substituted for the slurry and vibrated in place as described in U.S. Pat. No. 3,936,539 for treating hollow "finwall" members.

For some purposes the diffusion coating of internal surfaces can be effected in a heat that precedes or follows the diffusion coating of external surfaces. Thus hollow jet engine blades of B-1900 alloy have their exteriors preferably heavily diffusion coated in an aluminum-silicon (88–12 by weight) cementation pack at temperatures as low as about 1400° F., after which the coated blades are subjected to internal coating.

Diffusion coating the internal surfaces of such an externally coated product can cause the loss of excessive amounts of aluminum from the external case. Such loss can be reduced by the application of an aluminizing slurry over the external surfaces before the internal diffusion step, or by conducting the internal diffusion before the external pack diffusion.

The internal and external diffusions can be both conducted simultaneously to apply heavy coatings, as by uniformly distributing the slurry coating into the interior of a blade, and then embedding the thus-prepared blade in an aluminizing pack. Subjecting such an embedded blade to a 1400° F. diffusion-coating heat in a chromium-free aluminizing pack that does or does not contain silicon, followed by a post diffusion at 1975° F. or so for about four hours after removing the pack, yields a product that is nicely coated inside and heavily coated outside.

EXAMPLE 4

Hollow B-1900 jet engine blades in which the hollow interiors are accessible through a set of external openings each about 28 mils in diameter, have their hollow interiors cleaned. Very good cleaning is obtained by (a) first degreasing with methyl chloroform, (b) then projecting an air blast carrying very fine sand over the exteriors and also at the openings, with the blast directed to cause a substantial amount of the sand through to the interiors, (c) then continuing the air blast without the sand, to blow out all the sand, (d) then circulating through the hollow interiors, aqueous 10 weight % nitric acid for about two to about thirty minutes. A plastic hose has a cut-off end pressed against a blade exterior to encircle one or more of the openings into the blade interior, and the aqueous solution is poured or pumped into the tube so that it gets into the hollow interior and then drains out; (e) the blades and their interiors are now rinsed with water and dried.

A stirred slurry of the following composition is then pumped into the hollow interiors:

100 grams of an aluminum-silicon alloy powder containing 13 weight % silicon and passing completely through a 250 mesh screen, with no more than 15% retained by a 325 mesh screen.

6 grams poly(methyl acrylate)

100 grams methyl chloroform

The resin is permitted to dissolve in the solvent before the slurry pumping is started.

The slurry pumping is stopped, and a suction hose has a cut-off end promptly pressed for a few seconds against each of the external openings in turn while a suction pump sucks from the hose with an absolute pressure ¼ of atmospheric, to suck out excess slurry and leave the residual slurry uniformly over the surfaces of the hollow interior and of the passageways.

The blades are now permitted to stand about at least a few minutes to cause the slurry in the blades to set. They are then loaded into a diffusion-coating retort along with the following diffusion coating pack that need not be pre-fired:

15 grams of the same aluminum-silicon alloy powder used in the slurry 85 grams of white powdered fused alumina having an $Al_2O_3$ content of at least 99% by weight, all of the powder passing through an 80 mesh screen 0.5 gram powdered $NH_4Cl$ The loaded retort with all its blades covered by pack, is loosely covered and placed in an outer retort through which argon and then hydrogen is circulated as described in U.S. Pat. No. 3,764,371, as the assembly is heated to diffusion coating temperature. It is kept at 1350°-1400° F. for 2 hours, after which the heating is terminated and the assembly permitted to cool.

The retorts are then emptied, the blades removed, blown out with compressed air, washed with water, reloaded into the outer retort without the diffusion coating pack, and that retort then heated in hydrogen to 1975°-2000° F. where they are held for 5 hours. The heating is then stopped with hydrogen still flowing through the retort, the loaded retort withdrawn from the heating furnace, and rapidly cooled to 1000° F. with the help of fans directing ambient air against its exterior. This cooling takes 20 minutes, after which the parts can be heated in hydrogen, argon, or even air, hot, this time to 1650° F. where it is held for 10 hours to reharden the blades. The retort can then be cooled at the normal rate, and unloaded.

The $HNO_3$ treatment helps make the blade interior more uniformly wettable by the slurry, and for this purpose the $HNO_3$ concentration can vary from about 5 to about 20% by weight. Even better wettability is obtained when the $HNO_3$ solution also contains fluoride ion in a concentration of up to about 10% by weight, as in the stripping solution of U.S. Pat. No. 3,622,391.

Obviously many modifications and variations of the present invention are possible in the light of the above teachings. It is therefore to be understood that within the scope of the appended claims the invention may be practiced otherwise than as specifically described.

What is claimed:

1. In the diffusion coating of the internal surface of a hollow in a metal workpiece where that hollow is accessible only through a passageway less than about 5 millimeters wide, the improvement according to which there is applied over that internal surface an essentially uniform layer of particles consisting essentially of all the metal to be diffused into that surface, and the workpiece so treated is subjected to diffusion coating temperature while the hollow is exposed through the passageway to an energizer-containing diffusion coating atmosphere.

2. The combination of claim 1 in which the passageway is less than 2 millimeters wide.

3. The combination of claim 1 in which the layer of particles is a layer of a dispersion of the particles in a binder that is driven off at diffusion coating temperature.

4. The combination of claim 1 in which the essentially uniform layer is applied by first applying a coating of a mobile dispersion of the metal particles in a solution of an organic binder in a liquid solvent and then expelling coating to leave the desired essentially uniform layer.

5. The combination of claim 4 in which the binder is an acrylic resin.

6. The combination of claim 4 in which the expelling is accomplished by propelling a stream of gas against the mobile coating so that it moves thickened portions of the coating out the passageway.

7. The combination of claim 4 in which the expelling is accomplished by applying suction to the passageway to suck out thickened portions of the coating.

8. The combination of claim 1 in which the diffusion coating atmosphere is that produced by an energizer in contact with the diffusing metal at diffusion coating temperature.

9. The combination of claim 1 in which the workpiece is a superalloy.

10. The combination of claim 9 in which the diffusing metal is aluminum or chromium or mixtures of the two containing more than twice as much aluminum as chromium, by weight.

11. The combination of claim 9 in which the superalloy is a nickel base superalloy.

12. The combination of claim 1 in which the workpiece is a jet engine blade and the hollow is a cooling passageway in the interior of the blade.

13. The combination of claim 1 in which the workpiece has its external surface covered with a diffusion-applying layer during the diffusion coating.

14. The combination of claim 13 in which the diffusion coating applies to both the internal and the external surfaces of the workpiece, diffusion cases of the inward type.

15. The combination of claim 1 in which the exposure of the internally coated hollow workpiece to an energizer-containing diffusion coating atmosphere is effected by suspending the workpiece in a space contained in a diffusion-coating retort and supplying said atmosphere to that space.

16. The combination of claim 1 in which the exposure of the internally coated hollow workpiece to an energizer-containing diffusion coating atmosphere is effected by embedding the internally coated hollow workpiece in an activated diffusion-coating pack held in a diffusion-coating retort, and then heating the retort so loaded to diffusion coating temperature.

17. In the diffusion coating of a workpiece by holding it in a gaseous diffusion coating atmosphere at a diffusion coating temperature until the desired coating is formed on its surface, the improvement according to which the workpiece has an interior accessible only through a passageway less than about 5 millimeters wide, and before the diffusion coating treatment that interior is packed with a dry powdered diffusion coating pack that causes the interior to be diffusion coated by that pack while the exterior of the workpiece is diffusion coated by the diffusion coating atmosphere.

18. The combination of claim 9 in which the layer of particles is applied by introducing into the passageway a dispersion of the particles in a liquid, and before such introduction treating the surface of that passageway with nitric acid having a concentration between about 5 and about 20% by weight and containing up to about 10% fluoride ion by weight, to render that surface better wettable by the dispersion.

* * * * *